US008857928B2

(12) United States Patent
Coxon

(10) Patent No.: US 8,857,928 B2
(45) Date of Patent: Oct. 14, 2014

(54) APPLIANCE WITH A BRACKET FOR SUPPORTING A HINGE

(75) Inventor: David John Coxon, Louisville, KY (US)

(73) Assignee: General Electric Company, Schenectady, NY (US)

( * ) Notice: Subject to any disclaimer, the term of this patent is extended or adjusted under 35 U.S.C. 154(b) by 250 days.

(21) Appl. No.: 13/415,062

(22) Filed: Mar. 8, 2012

(65) Prior Publication Data

US 2013/0234573 A1 Sep. 12, 2013

(51) Int. Cl.
*A47B 88/00* (2006.01)

(52) U.S. Cl.
USPC ..... 312/328

(58) Field of Classification Search
USPC ..... 312/228, 326–329; 16/380
See application file for complete search history.

(56) References Cited

U.S. PATENT DOCUMENTS

| | | | | | |
|---|---|---|---|---|---|
| 2,284,320 | A * | 5/1942 | Howe | 16/250 |
| 2,309,001 | A * | 1/1943 | Nave et al. | 49/398 |
| 2,319,600 | A * | 5/1943 | Heath | 49/398 |
| 2,578,610 | A * | 12/1951 | Stone | 16/390 |
| 3,378,880 | A * | 4/1968 | Haldopoulos et al. | 16/337 |
| 3,883,201 | A * | 5/1975 | Busoni | 49/167 |
| 5,611,609 | A * | 3/1997 | Katz et al. | 312/263 |
| 7,275,398 | B2 * | 10/2007 | Kim et al. | 68/3 R |
| 2009/0064534 | A1 * | 3/2009 | LeClerc | 34/603 |

FOREIGN PATENT DOCUMENTS

RU 2368749 9/2009

* cited by examiner

*Primary Examiner* — Darnell Jayne
*Assistant Examiner* — Timothy M Ayres
(74) *Attorney, Agent, or Firm* — Dority & Manning, P.A.

(57) ABSTRACT

A washing machine appliance is provided with a door rotatably mounted to a cabinet of the appliance with a hinge. The hinge is supported by a bracket that extends between a front panel of the appliance and a flange. By extending between the front panel and the flange, the bracket can provide robust support for the hinge.

16 Claims, 4 Drawing Sheets

APPLIANCE WITH A BRACKET FOR SUPPORTING A HINGE

FIELD OF THE INVENTION

The present subject matter relates generally to appliances with a bracket for supporting a hinge that mounts a door to the appliance.

BACKGROUND OF THE INVENTION

Front loading washing machines have a door mounted to a front panel of the appliance. The door permits access to the wash chamber of the appliance for loading and/or removal of articles in the wash chamber. In front loading washing machines, the door is mounted to the cabinet with a hinge. The hinge permits the door to rotate open and closed.

In certain washing machine appliance, the hinge is mounted to the front panel of the appliance with fasteners that extend through the front panel into a bracket that supports the hinge. However, when the bracket is mounted to the front panel using only fasteners that extend through the front panel into the bracket, the hinge receives limited support during opening and/or closing of the door. Thus, the hinge can feel flimsy and negatively impact a consumer's perception of the appliance. Accordingly, a washing machine appliance with features for more robustly mounting a hinge to a front panel of the appliance would be appreciated.

In addition, in certain washing machine appliances, the front panel is constructed of a sheet metal or another similar semi-rigid material. Thus, during opening and/or closing of the appliance's door, the front panel can deflect or bend. A user opening or closing the door can perceive the appliance as lacking in quality due to the panel's relatively low stiffness. Accordingly, a washing machine appliance with features for increasing the stiffness of the appliance's front panel would be useful.

Certain washing machine appliances include steel bracing to increase the stiffness of the appliance's front panel. The steel bracing generally extends between the top and bottom of the front panel. However, the effectiveness of such bracing is limited. Also, steel bracing can add to the overall cost of producing the appliance and can also consume valuable space within the appliance's cabinet. Accordingly, a washing machine appliance with features for increasing the stiffness of the appliance's front panel without using such bracing would be useful.

BRIEF DESCRIPTION OF THE INVENTION

Aspects and advantages of the invention will be set forth in part in the following description, or may be obvious from the description, or may be learned through practice of the invention.

In a first embodiment, an appliance is provided. The appliance includes a cabinet with a door casing assembly. The door casing assembly includes a front panel. A side panel extends from an edge of the front panel towards the cabinet. A flange extends from the side panel such that the flange is spaced apart from the front panel and is substantially parallel to the front panel. A drum is rotatably mounted within the cabinet. The drum defines a chamber for receipt of articles. A door is configured for permitting selective access to the chamber of the drum. A hinge rotatably mounts the door to the door casing assembly. The hinge is configured for rotation about an axis. A bracket is mounted to the door casing assembly for supporting the hinge. The bracket has a first surface and a second surface. The first surface of the bracket is positioned adjacent the flange. The second surface of the bracket is positioned adjacent the front panel.

In a second embodiment, an appliance is provided. The appliance includes a cabinet having a door casing assembly. The door casing assembly has a front panel. A side panel extends from an edge of the front panel towards the cabinet. A flange extends from the side panel such that the front panel, the side panel, and the flange cooperate to define a pocket. A drum is rotatably mounted within the cabinet. The drum defines a chamber for receipt of articles. A door is configured for permitting selective access to the chamber of the drum. A hinge rotatably mounts the door to the door casing assembly of the cabinet. The hinge is configured for rotation about an axis. A bracket supports the hinge. The bracket is mounted to the door casing assembly. At least a portion of the bracket is received within the pocket of the door casing assembly such that the bracket extends between the front panel of the door casing assembly and the flange of the door casing assembly.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
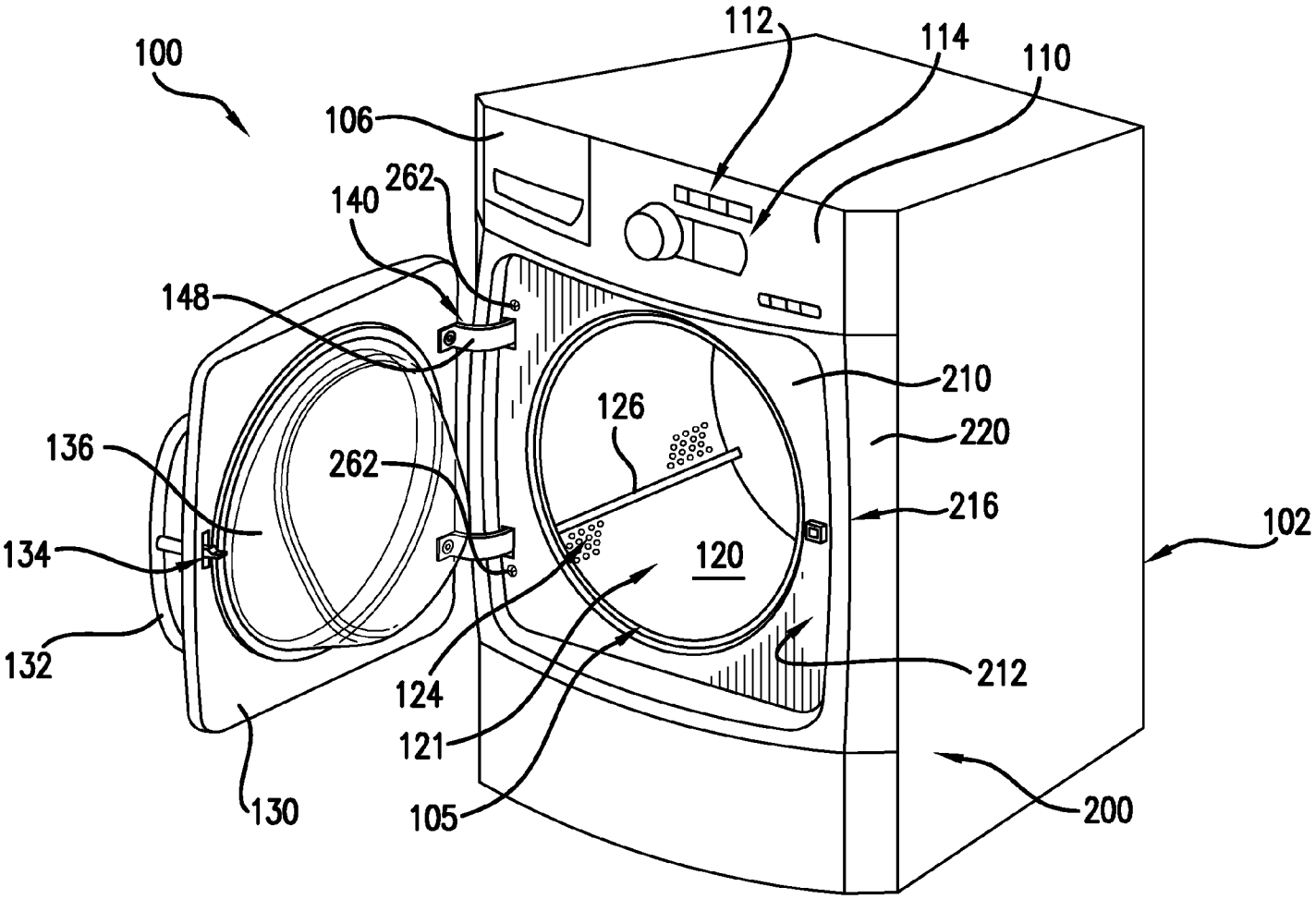
FIG. 1 provides perspective view of a washing machine appliance according to an exemplary embodiment of the present subject matter and also illustrates a hinge rotatably mounting a door to a cabinet of the appliance.

An appliance is provided with a door rotatably mounted to a cabinet of the appliance with a hinge. The hinge is supported by a bracket that extends between a front panel of the appliance and a flange. By extending between the front panel and the flange, the bracket can provide a robust support for the hinge. Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 illustrates an exemplary horizontal axis washing machine appliance 100. However, while described in the context of a specific embodiment of horizontal axis washing machine appliance 100, using the teachings disclosed herein, it will be understood that horizontal axis washing machine appliance 100 is provided by way of example only. Other washing machine appliances having different configurations, different appearances, and/or different features may also be utilized with the present subject matter as well. In addition, the teachings disclosed herein may be used with other appliances as well, e.g., a dryer appliance.

Washing machine appliance 100 has a cabinet 102 with a drum 120 rotatably mounted therein. A motor (not shown) is in mechanical communication with drum 120 in order to selectively rotate drum 120 (e.g., during an agitation or a rinse cycle of washing machine appliance 100). Drum 120 defines a wash chamber 121 that is configured for receipt of articles for washing. Ribs 126 extend from drum 120 into wash chamber 121. Ribs 126 assist agitation of articles disposed within wash chamber 121 during operation of washing machine appliance 100. For example, ribs 126 may lift articles disposed in drum 120 during rotation of drum 120. Drum 120 also defines a plurality of holes 124. Holes 124 are configured to permit a flow of wash fluid and/or air between an interior of drum 120 and an exterior of drum 120. A detergent drawer 106 is slidably mounted within cabinet 102. Detergent drawer 106 receives detergent and directs the detergent to wash chamber 121 during operation of appliance 100.

Figure 2:
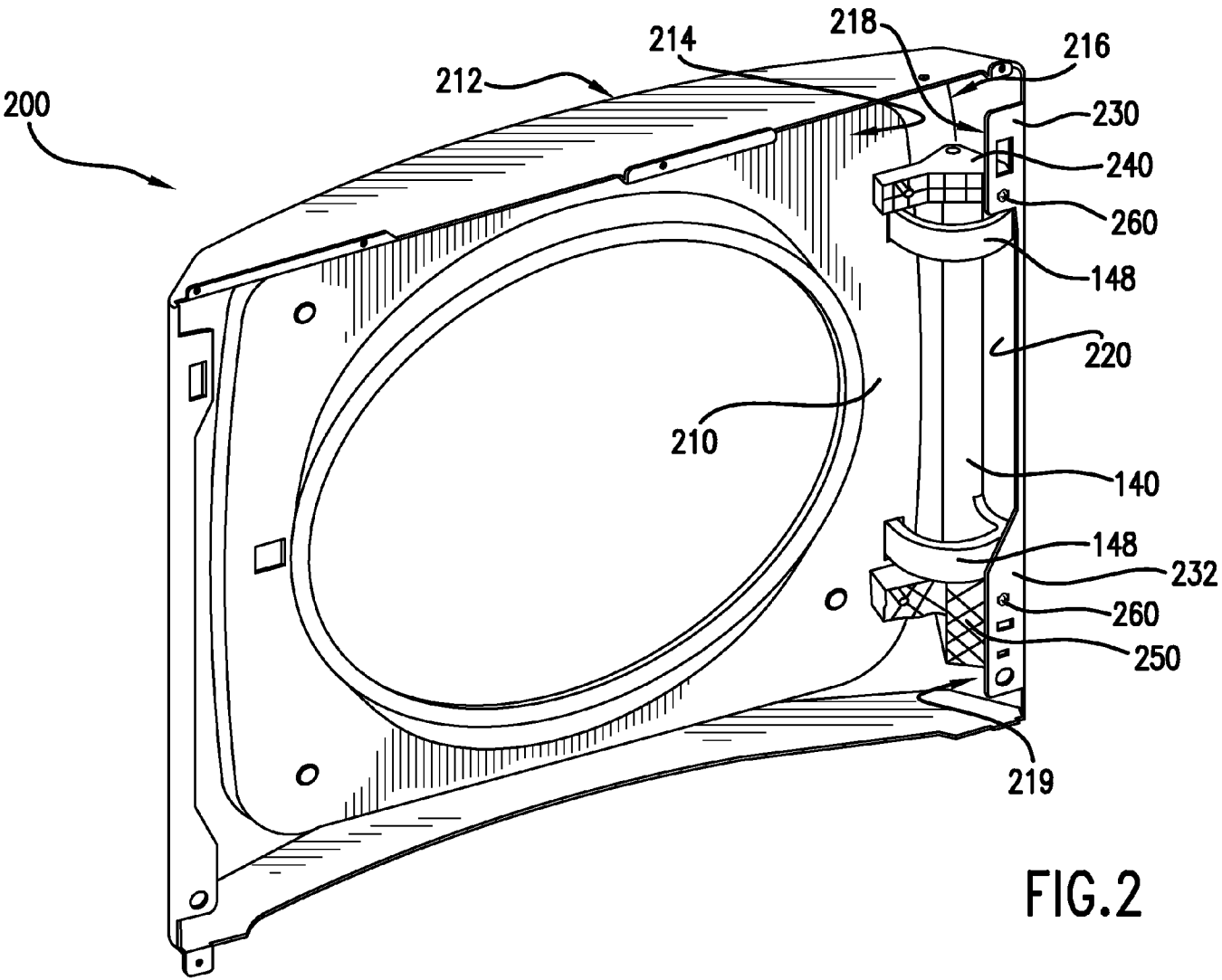
FIG. 2 provides a rear perspective view of an exemplary door casing assembly of FIG. 1 with the door removed for clarity and, in particular, illustrates the hinge mounted to the door casing assembly with an exemplary pair of brackets.

As shown in FIGS. 1 and 2, cabinet 102 of washing machine appliance 100 has a door casing assembly 200. Door casing assembly 200 defines an opening 105 that permits user access to wash chamber 121 of drum 120. A door 130 is mounted to door casing assembly 200 with a hinge 140. A window 136 in door 130 permits viewing of wash chamber 121 during operation of appliance 100. Door 130 also includes a handle 132 that, e.g., a user may pull when opening and closing door 130. Latch 134 is configured for selectively securing door 120 in a closed configuration (i.e., a configuration in which door 120 is positioned adjacent door casing assembly 104).

A control panel 110 with a plurality of input selectors 112 is also mounted to cabinet 102. Control panel 110 and input selectors 112 collectively form a user interface for operator selection of machine cycles and features. A display 114 of control panel 130 indicates selected features, a countdown timer, and/or other items of interest to appliance users.

Operation of washing machine appliance 100 is controlled by a controller or processing device (not shown), that is operatively coupled to control panel 110 for user manipulation to select washing machine cycles and features. In response to user manipulation of control panel 110, the controller operates the various components of washing machine appliance 100 to execute selected machine cycles and features.

In an illustrative embodiment, laundry items are loaded into wash chamber 121, and washing operation is initiated through operator manipulation of input selectors 112. Drum 120 is filled with water and detergent to form a wash fluid. One or more valves (not shown) can be controlled by washing machine appliance 100 to provide for filling drum 120 to the appropriate level for the amount of articles being washed. Once drum 120 is properly filled with fluid, the contents of wash chamber 121 are agitated with ribs 126 for cleansing of laundry items in drum 120.

After the agitation phase of the wash cycle is completed, drum 120 is drained. Laundry articles can then be rinsed by again adding fluid to drum 120, depending on the particulars of the cleaning cycle selected by a user, ribs 126 may again provide agitation within wash chamber 121. One or more spin cycles may also be used. In particular, a spin cycle may be applied after the wash cycle and/or after the rinse cycle in order to wring wash fluid from the articles being washed. During a spin cycle, drum 120 is rotated at relatively high speeds.

FIG. 2 illustrates a rear perspective view of the door casing assembly 200 of appliance 100 with door 130 removed for clarity. Door casing assembly 200 includes a front panel 210. Front panel 210 has an exterior surface 212 (FIG. 1) and an interior surface 214. Door 130 (FIG. 1) is positioned adjacent exterior surface 212 of front panel 210 in the closed position (not shown).

A side panel 220 extends from an outer edge 216 of front panel 210. Side panel 220 extends from front panel 210 towards cabinet 102 (FIG. 1). As may be seen in FIG. 1, side panel 220 extends away from front panel 210 at an angle such that door casing assembly 200 has a beveled appearance. However, side panel 220 may extend away from front panel 210 in any suitable manner. For example, side panel 220 may extend away from front panel 210 such that side panel 220 is substantially perpendicular to front panel 210. Also, in FIG. 1, side panel 220 is substantially flat. However, side panel 220 may be, e.g., rounded or have any other suitable shape or profile.

Turning back to FIG. 2, a tab or flange 230 extends from side panel 220. Flange 230 is spaced apart from front panel 210 and is substantially parallel to front panel 210. By parallel or substantially parallel, it is meant that flange 230 is parallel or about parallel (e.g., within about five, ten, or fifteen degrees) to at least a portion of front panel 210. For example, when front panel 210 has rounded or beveled features, at least a portion of front panel 210 is parallel to flange 230.

Flange 230 can assist in mounting door casing assembly 200 to cabinet 102 (FIG. 1). For example, hooks (not shown) may extend from cabinet 102 into flange 230 in order to hang door casing assembly 200 from cabinet 102. Fasteners or other suitable mechanisms may also be used to secure door casing assembly 200 to cabinet 102.

Front panel 210, side panel 220, and flange 230 cooperate to define a pocket 218. Pocket 218 is configured for receipt of a bracket 240. Bracket 240 is received within pocket 218 and mounted to door casing assembly 200.

An additional flange 232 also extends from side panel 220. Like flange 230, additional flange 232 is spaced apart from front panel 210. Additional flange 232 is also be substantially parallel to front panel 210 and may assist flange 230 in mounting door casing assembly 200 to cabinet 102 in a manner similar to that described above.

Front panel 210, side panel 220, and additional flange 232 cooperate to define an additional pocket 219. Additional pocket 219 is configured for receipt of an additional bracket 250. Additional bracket 250 is received within additional pocket 219 and mounted to door casing assembly 200.

Figure 3:
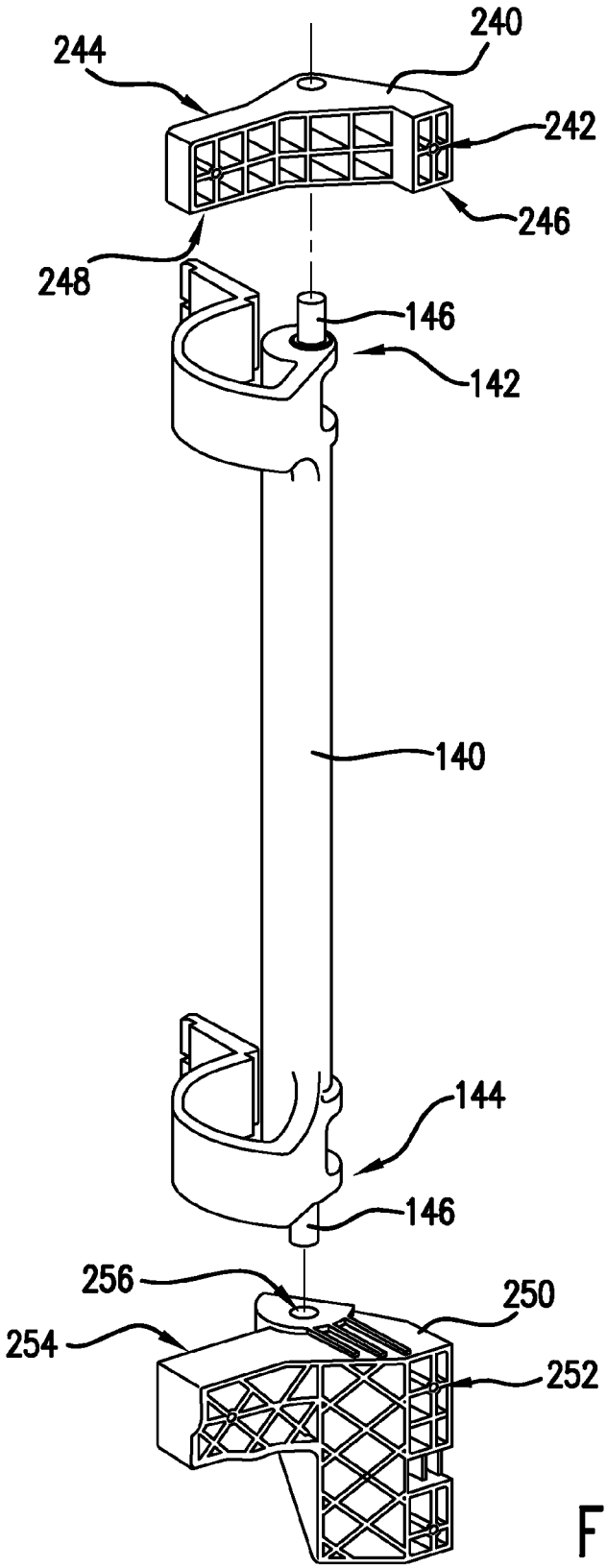
FIG. 3 illustrates an exploded view of the hinge and pair of brackets of FIG. 2.
Figure 4:
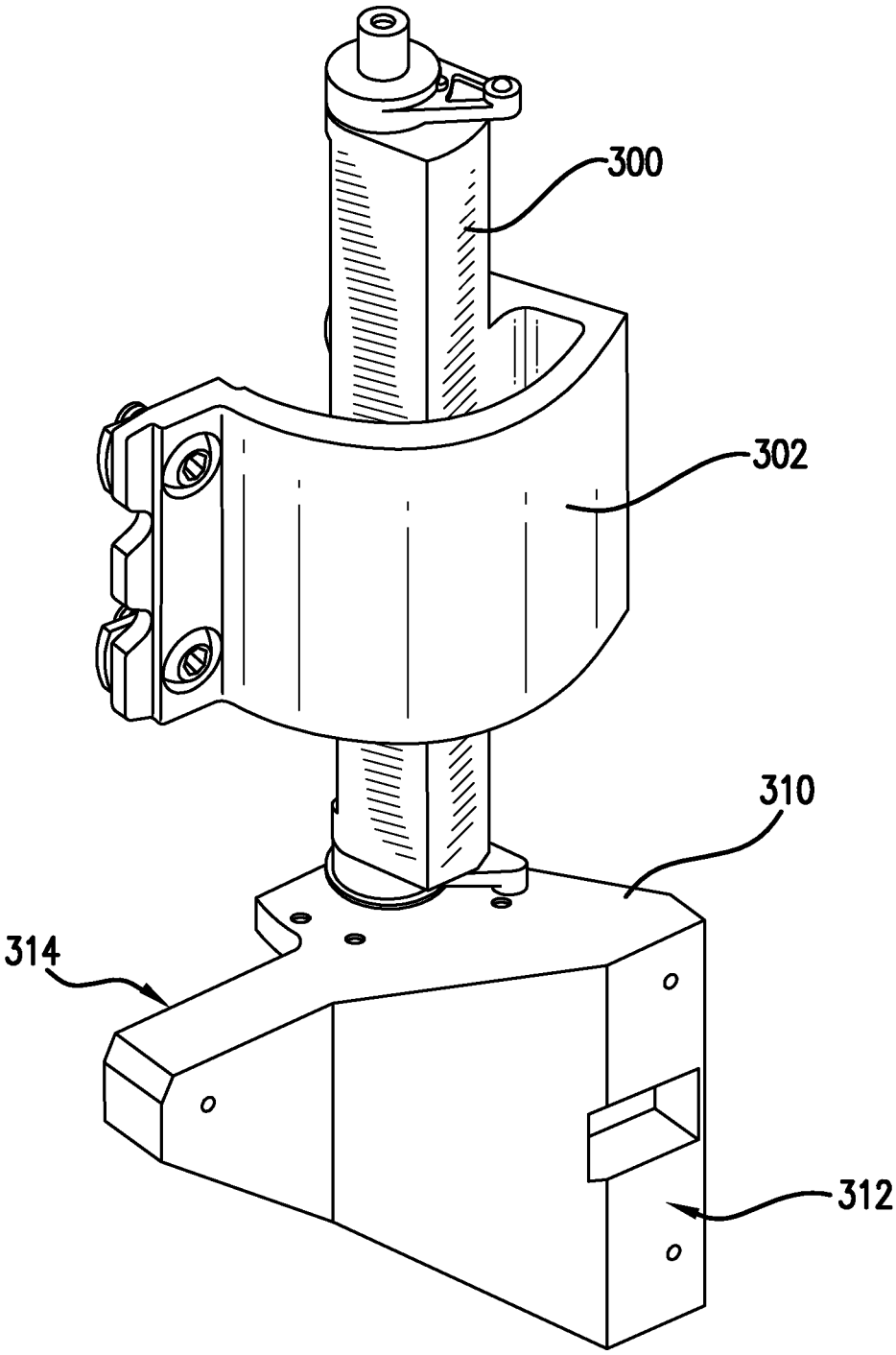
FIG. 4 illustrates a perspective view of a hinge supported by a bracket according to an exemplary embodiment of the present subject matter.

FIG. 3 illustrates an exploded view of hinge 140, bracket 240, and additional bracket 250. Hinge 140 extends between a top 142 and a bottom 144. Posts 146 extend from top 142 and bottom 144 of hinge 140. Posts 146 are configured for receipt by bracket 140 and additional bracket 150. For example, one of posts 146 may be disposed within a hole 256 defined by additional bracket 250. Hinge 140 may rotate about post 146 within hole 256, e.g., during opening and closing of door 130. Other configurations may be used to support hinge 140 as well.

Bracket 240 has a first surface 242 and a second surface 244. First surface 242 of bracket 240 is spaced apart from second surface 244 of bracket 240. Bracket 240 also extends between a first end 246 and second end 248. Additional bracket 250 also has a first surface 252 and a second surface 254.

Referring back to FIG. 2, first surface 242 (FIG. 3) of bracket 240 is positioned adjacent flange 230, and second surface 244 (FIG. 3) of bracket 240 is positioned adjacent interior surface 214 of front panel 210. Thus, bracket 240 is at least partially disposed within pocket 218 such that bracket 240 extends between flange 230 and front panel 210. Similarly, first surface 252 (FIG. 3) of additional bracket 250 is positioned adjacent flange 230, and second surface 254 (FIG. 3) of additional bracket 250 is positioned adjacent interior surface 214 of front panel 210. Thus, additional bracket 250 is disposed at least partially within additional pocket 219 such that additional bracket 250 extends between flange 230 and front panel 210.

Fasteners 260 extend through flange 230 and additional flange 232 into bracket 240 and additional bracket 250 respectively. Fasteners 260 assist in mounting bracket 240 and additional bracket 250 to door casing assembly 200. As may be seen in FIG. 1, additional fasteners 262 extend through front panel 210 into bracket 240 (FIG. 2) and additional bracket 250 (FIG. 2). Additional fasteners 250 also assist in mounting bracket 240 and additional bracket 250 to door casing assembly 200.

As discussed above, bracket 240 extends between first end 246 and second end 248. Fastener 260 extends through flange 230 into bracket 240 at first end 246 of bracket 240. Additional fastener 262 extends through front panel 210 into bracket 240 at second end 248 of bracket 240. Thus, bracket 240 is mounted to both front panel 210 and flange 230.

In FIG. 2, hinge 140 is rotatably supported by bracket 240 and additional bracket 250. Attachment arms 148 of hinge 140 extend through front panel 210 and are coupled to door 130 (FIG. 1) in order to mount door 130 to hinge 140. By mounting bracket 240 to front panel 210 and flange 230, bracket 240 provides a robust and stable support for hinge 140 and door 130. Similarly, door casing assembly 200 may be constructed of sheet metal, plastic, or any other suitable semi-rigid material. Thus, door casing assembly 200 can deform during opening and/or closing of door 130. By mounting bracket 240 to front panel 210 and flange 230, such deformation can be reduced and/or minimized. Thus, the rigidity of door casing assembly 200 can be increased.

In the embodiment shown in FIGS. 2 and 3, bracket 240 and additional bracket 250 are constructed of plastic. However, it should be understood that bracket 240 and additional bracket 250 may be constructed of any other suitable material. For example, bracket 250 may be constructed of metal. Also, it should be understood that bracket 240 and/or additional bracket 250 may be mounted to door casing assembly 200 in any suitable alternative manner (e.g., clips, hooks, and/or glue).

FIG. 6 provides an additional hinge 300 embodiment. Hinge 300 may, e.g., be used in washing machine appliance 100 of FIG. 1 to mount door 130 to cabinet 102. Alternatively, hinge 300 may be utilized when a single hinge arm rather than dual hinge arms are needed to secure a door to a cabinet. For example, in washing machine appliances with round rather than square doors, a single hinge arm 302 is needed to secure a door to a cabinet. Thus, hinge 300 may be used when door 130 has a round profile rather than the square profile shown in FIG. 1.

An alternative bracket 310 embodiment is shown as well. Like bracket 240, bracket 310 is configured for receipt by a pocket of a door casing assembly such that a first surface 312 of bracket 310 is disposed adjacent a front panel of the door casing assembly and a second surface 314 of bracket is disposed adjacent a flange of the door casing assembly.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An appliance comprising:

a cabinet having a door casing assembly, the door casing assembly including:

a front panel;

a side panel extending from an edge of the front panel towards said cabinet;

a flange extending from the side panel such that the flange is spaced apart from the front panel and is substantially parallel to the front panel; and an additional flange extending from the side panel such that the additional flange is spaced apart from the front panel and is substantially parallel to the front panel;

a drum rotatably mounted within said cabinet, said drum defining a. chamber for receipt of articles;

a door configured for permitting selective access to the chamber of said drum;

a hinge for rotatably mounting said door to said door casing assembly, said hinge configured for rotation about an axis, said hinge extending between a top portion and a bottom portion;

a bracket mounted to said door casing assembly for supporting the top portion of said hinge, said bracket having a first surface and a second surface, the first surface of said bracket positioned adjacent said flange, the second surface of said bracket positioned adjacent said front panel; and an additional bracket mounted to said door casing assembly for supporting the bottom portion of said hinge assembly, said additional bracket having a first surface and a second surface, the first surface of said additional bracket positioned adjacent said additional flange, the second surface of said additional bracket positioned adjacent said front panel.

2. The appliance of claim 1, wherein a fastener extends through the front panel into said bracket to assist in mounting said bracket to door casing assembly.

3. The appliance of claim 1, wherein a fastener extends through said flange into said bracket to assist in mounting said bracket to said front panel.

4. The appliance of claim 1, wherein said bracket extends between a first end and a second end, the first end of said bracket mounted to said flange, the second end of said bracket mounted to said front panel.

5. The appliance of claim 1, wherein said hinge defines a post received by a hole defined by said bracket, said hinge rotating about the post in the hole.

6. The appliance of claim 1, wherein said bracket is constructed of plastic.

7. The appliance of claim 1, wherein said door casing assembly is constructed of a plastic and said bracket assists in increasing the stiffness of said door casing.

8. The appliance of claim 1, wherein the appliance is a washing machine Appliance.

9. An appliance comprising:

a cabinet having a door casing assembly, the door casing assembly including:

a front panel;

a side panel extending from an edge of the front panel towards said cabinet; and a flange extending from the side panel such that the front panel, the side panel, and the flange cooperate to define a pocket and an additional pocket;

a drum rotatably mounted within said cabinet, said drum defining a chamber for receipt of articles;

a door configured for permitting selective access to the chamber of said drum;

a hinge for rotatably mounting said door to the door casing assembly of said cabinet, said hinge configured for rotation about an axis, said hinge extending between a top portion and a bottom portion;

a bracket for supporting the top portion of said hinge, said bracket mounted to said door casing assembly, at least a portion of said bracket received within the pocket of said door casing assembly such that said bracket extends between the front panel of said door casing assembly and the flange of said door casing assembly; and an additional bracket for supporting the bottom portion of said hinge, said additional bracket mounted to said door casing assembly, at least a portion of said additional bracket received within the additional pocket, said additional bracket extending between said front panel and said flange.

10. The appliance of claim 9, wherein a fastener extends through the front panel into said bracket to assist in mounting said bracket to said door casing assembly.

11. The appliance of claim 9, wherein a fastener extends through the flange into said bracket to assist in mounting said bracket to said door casing assembly.

12. The appliance of claim 9, wherein said bracket extends between a first end and a second end, the first end of said bracket mounted to the flange of said door casing assembly, the second end of said bracket mounted to the front panel of said door casing assembly.

13. The appliance of claim 9, wherein said hinge defines a post received by a hole defined by said bracket, said hinge rotating about the post within the hole.

14. The appliance of claim 9, wherein said bracket is constructed of plastic.

15. The appliance of claim 9, wherein said door casing assembly is constructed of a plastic and said bracket assists in increasing the stiffness of said door casing.

16. The appliance of claim 9, wherein the appliance is a washing machine appliance.

* * * * *